US008626017B2

(12) United States Patent
Sakatani et al.

(10) Patent No.: US 8,626,017 B2
(45) Date of Patent: Jan. 7, 2014

(54) IMAGE FORMING DEVICE AND DEVELOPER SUPPLY METHOD INCLUDING PRE-SUPPLY TONER DETECTION

(75) Inventors: Kazuomi Sakatani, Sagamihara (JP); Katsuyuki Hirata, Toyokawa (JP); Yoshinori Tsutsumi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 301 days.

(21) Appl. No.: 13/119,740

(22) PCT Filed: Sep. 25, 2009

(86) PCT No.: PCT/JP2009/066603

§ 371 (c)(1),
(2), (4) Date: Mar. 18, 2011

(87) PCT Pub. No.: WO2010/038659

PCT Pub. Date: Apr. 8, 2010

(65) Prior Publication Data

US 2011/0170890 A1 Jul. 14, 2011

(30) Foreign Application Priority Data

Sep. 30, 2008 (JP) ..... 2008-252559

(51) Int. Cl.
*G03G 15/08* (2006.01)

(52) U.S. Cl.
USPC ..... 399/62; 399/63

(58) Field of Classification Search
USPC ..... 399/58, 61, 62, 63
See application file for complete search history.

(56) References Cited

U.S. PATENT DOCUMENTS 4,277,549 A * 7/1981 Tatsumi et al. ..... 399/58
4,342,283 A * 8/1982 Terashima ..... 399/63

(Continued)

FOREIGN PATENT DOCUMENTS

JP 5-6090 A 1/1993
JP 5-40408 A 2/1993

(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) issued on May 19, 2011, in the corresponding International Application No. PCT/JP2009/066603.

(Continued)

*Primary Examiner* — Susan Lee
(74) *Attorney, Agent, or Firm* — Buchanan Ingersoll & Rooney PC

(57) ABSTRACT

There are provided a powder supply element adapted to supply powders containing at least toner; developing element adapted to develop an electrostatic latent image by agitating and conveying a developer containing the powders that are supplied by the powder supply element; a toner amount detecting element that is placed in the middle of a conveyance path to connect the powder supply element with the developing element and detects a toner amount per unit volume to be supplied to the developing element; and control element that controls a correction amount with respect to a reference supply amount due to the powder supply element on the basis of a toner amount per unit volume that is detected by the toner amount detecting element.

12 Claims, 15 Drawing Sheets

(56) References Cited

U.S. PATENT DOCUMENTS

| | | | | |
|---|---|---|---|---|
| 4,405,226 | A * | 9/1983 | Kimura et al. | 399/63 |
| 4,452,174 | A * | 6/1984 | Fedder | 399/62 |
| 5,652,947 | A * | 7/1997 | Izumizaki | 399/58 |
| 6,345,163 | B1 * | 2/2002 | Suzuki et al. | 399/61 |
| 6,389,244 | B1 * | 5/2002 | Shima et al. | 399/58 |
| 6,987,934 | B2 * | 1/2006 | Bessho et al. | 399/61 |
| 2004/0009015 | A1 | 1/2004 | Fujimori et al. | |
| 2007/0058995 | A1 * | 3/2007 | Onda et al. | |
| 2007/0274740 | A1 * | 11/2007 | Katoh et al. | |
| 2008/0069596 | A1 * | 3/2008 | Katsuyama et al. | |

FOREIGN PATENT DOCUMENTS

| | | | |
|---|---|---|---|
| JP | 8-95362 | A | 4/1996 |
| JP | 2004-4394 | A | 1/2004 |
| JP | 2006-113409 | A | 4/2006 |
| JP | 2006-178279 | A | 7/2006 |
| JP | 2007-140291 | A | 6/2007 |
| JP | 2007-148277 | A | 6/2007 |
| JP | 2008-3560 | A | 1/2008 |

OTHER PUBLICATIONS

International Search Report (PCT/ISA/210) issued on Oct. 27, 2009, by Japanese Patent Office as the International Searching Authority for International Application No. PCT/JP2009/066603.

Office Action issued on Oct. 27, 2009 in corresponding Japanese Patent Application No. 2008-252559.

* cited by examiner

Fig. 7

| | AVERAGE CONCENTRATION OF TONER (%) | | | | | | | | |
|---|---|---|---|---|---|---|---|---|---|
| ESTIMATED CONSUMPTION AMOUNT (mg) | ～4.5 | 4.5～5 | 5～5.5 | 5.5～6 | ・ | ・ | 8～8.5 | 8.5～9 | 9～ |
| 0 | 100 | 80 | 60 | 40 | ・ | ・ | 0 | 0 | 0 |
| 0～10 | 110 | 90 | 70 | 50 | ・ | ・ | 0 | 0 | 0 |
| 10～20 | 120 | 100 | 80 | 60 | ・ | ・ | 0 | 0 | 0 |
| 20～30 | 130 | 110 | 90 | 70 | ・ | ・ | 0 | 0 | 0 |
| 30～40 | 140 | 120 | 100 | 80 | ・ | ・ | 0 | 0 | 0 |
| 40～50 | 150 | 130 | 110 | 90 | ・ | ・ | 10 | 0 | 0 |
| 50～60 | 160 | 140 | 120 | 100 | ・ | ・ | 20 | 10 | 0 |
| 60～70 | 170 | 150 | 130 | 110 | ・ | ・ | 30 | 20 | 0 |
| 70～80 | 180 | 160 | 140 | 120 | ・ | ・ | 40 | 30 | 0 |
| ・ | ・ | ・ | ・ | ・ | ・ | ・ | ・ | ・ | ・ |
| ・ | ・ | ・ | ・ | ・ | ・ | ・ | ・ | ・ | ・ |
| ・ | ・ | ・ | ・ | ・ | ・ | ・ | ・ | ・ | ・ |
| 330～340 | 440 | 420 | 400 | 380 | ・ | ・ | 300 | 290 | 0 |
| 340～350 | 450 | 430 | 410 | 390 | ・ | ・ | 310 | 300 | 0 |
| 350～360 | 460 | 440 | 420 | 400 | ・ | ・ | 320 | 310 | 0 |
| 360～370 | 470 | 450 | 430 | 410 | ・ | ・ | 330 | 320 | 0 |
| 370～380 | 480 | 460 | 440 | 420 | ・ | ・ | 340 | 330 | 0 |
| 380～390 | 490 | 470 | 450 | 430 | ・ | ・ | 350 | 340 | 0 |
| 390～400 | 500 | 480 | 460 | 440 | ・ | ・ | 360 | 350 | 0 |
| 400～ | 500 | 490 | 470 | 450 | ・ | ・ | 370 | 360 | 0 |

Fig. 8

| REFERENCE SUPPLY AMOUNT (mg) | CONCENTRATION OF DETECTED TONER IN SUB HOPPER (%) | | | | | |
|---|---|---|---|---|---|---|
| | ～50 | 50～60 | 60～70 | 70～80 | 80～90 | 90～100 |
| 40 | 32 | 20 | 11 | 5 | 0 | -4 |
| 60 | 48 | 30 | 17 | 8 | 0 | -6 |
| 80 | 64 | 40 | 23 | 10 | 0 | -8 |
| 100 | 80 | 50 | 29 | 13 | 0 | -10 |
| 120 | 96 | 60 | 34 | 15 | 0 | -12 |
| 140 | 112 | 70 | 40 | 18 | 0 | -14 |
| 160 | 128 | 80 | 46 | 20 | 0 | -16 |
| 180 | 144 | 90 | 51 | 23 | 0 | -18 |
| 200 | 160 | 100 | 57 | 25 | 0 | -20 |
| 220 | 176 | 110 | 63 | 28 | 0 | -22 |
| 240 | 192 | 120 | 69 | 30 | 0 | -24 |
| 260 | 208 | 130 | 74 | 33 | 0 | -26 |
| 280 | 224 | 140 | 80 | 35 | 0 | -28 |
| 300 | 240 | 150 | 86 | 38 | 0 | -30 |
| 320 | 256 | 160 | 91 | 40 | 0 | -32 |
| 340 | 272 | 170 | 97 | 43 | 0 | -34 |
| 360 | 288 | 180 | 103 | 45 | 0 | -36 |
| 380 | 304 | 190 | 109 | 48 | 0 | -38 |
| 400 | 320 | 200 | 114 | 50 | 0 | -40 |
| 420 | 336 | 210 | 120 | 53 | 0 | -42 |
| 440 | 352 | 220 | 126 | 55 | 0 | -44 |
| 460 | 368 | 230 | 131 | 58 | 0 | -46 |
| 480 | 384 | 240 | 137 | 60 | 0 | -48 |
| 500 | 400 | 250 | 143 | 63 | 0 | -50 |

IMAGE FORMING DEVICE AND DEVELOPER SUPPLY METHOD INCLUDING PRE-SUPPLY TONER DETECTION

This application is based on Application No. 2008-252559 filed in Japan on Sep. 30, 2008, the entire content of which is hereby incorporated by reference.

TECHNICAL FIELD

The present invention relates to an image forming device and a developer supply method.

BACKGROUND ART

Conventionally, as an image forming device, the constitution to control the amount of toner to be supplied to a developer bottle on the basis of the concentration of the toner in a developer bottle has been publicly known (for example, refer to Japanese Patent Application Laid-Open No. 5-6090).

In addition, as other image forming device, the constitution to control the supply amount of the toner to a developer bottle in response to the number of printing dots (a dot count value) has been publicly known (for example, refer to Japanese Patent Application Laid-Open No. 5-40408).

DISCLOSURE OF THE INVENTION

Problems to be Solved by the Invention

Generally, in the image forming device, variations are generated in the aspect of the toner (a capacity, a concentration, and a bulk density or the like) to be supplied depending on a difference in an environmental condition such as a temperature and humidity. However, in the above-described conventional image forming device, it is impossible to appropriately maintain the concentration of the toner in a developing device in consideration of change of the aspect of the toner due to such a difference in an environmental condition. In other words, this is because it is not possible to eliminate the influence of change in the aspect of the toner to be actually supplied to the inside of the developing device merely by measuring the concentration of the toner in the developing device.

Therefore, an object of the present invention is to provide an image forming device and a developer supply method that can obtain a desired concentration of the toner in consideration of change in the aspect of a toner to be supplied.

Means Adapted to Solve the Problems

In accordance with one aspect of the present invention, there is provided an image forming device including:

powder supply means adapted to supply powders containing at least toner;

developing means adapted to develop an electrostatic latent image by agitating and conveying a developer containing the powders that are supplied by the powder supply means;

means of detecting toner amount before supply that is placed in the middle of a conveyance path to connect the powder supply means with the developing means and detects a toner amount per unit volume to be supplied to the developing means; and control means that controls a correction amount with respect to a reference supply amount due to the powder supply means on the basis of a toner amount per unit volume that is detected by the toner amount detecting means.

Further, the reference supply amount means a supply amount of powder that can supply the toner, which amount is equivalent to a toner consumption amount to be calculated on the basis of the dot count value and a toner consumption amount that is obtained by the toner remaining amount to be calculated in response to a decrease level of the concentration of the toner within the developing means.

According to the above-described constitution, detecting the amount of the toner per unit volume just before the toner is supplied to the developing means and correcting the reference supply amount on the basis of this result, it is possible to consider variation of the aspect of the toner. Accordingly, this makes it possible to control the concentration of the toner within the developing means into a desired value.

In the above aspect, a hopper that accumulates the powders to be supplied once is placed in the middle of a supply path reaching from the powder supply means to the developing means;

agitation means adapted to agitate the accumulated powders is placed in the hopper; and the toner amount before supply detecting means is placed in the hopper.

According to the above-described constitution, it is possible to detect the amount of the toner per unit volume with the powders just before they are supplied to the inside of the developing means sufficiently agitated to unify the concentration of the toner. As a result, making the toner supply amount to the developing means into a desired value, it is possible to make the concentration of the toner of the developer within the developing means into the desired value.

In the above aspect, the toner amount detecting means comprises a magnetic permeability sensor and a magnetic body that are arranged across the supply path reaching from the powder supply means to the developing means; and the control means calculates a toner amount to be supplied on the basis of a bulk density of the toner passing through the supply path, which bulk density is detected by the permeability sensor and the magnetic body, so as to control the correction amount with respect to the reference supply amount.

In the above aspect, the powders to be supplied from the powder supply means to the developing means is toner.

In the above aspect, the powder to be supplied from the powder supply means to the developing means is toner and a carrier.

In accordance with another aspect of the present invention, there is provided a developer supply method including:

detecting a toner amount per unit volume to be supplied to the developing means in the middle of a conveyance path to connect powder supply means adapted to supply powders containing at least toner with developing means adapted to develop an electrostatic latent image by agitating and conveying a developer containing the powders that are supplied by the powder supply means; and controlling a correction amount with respect to a reference supply amount due to the powder supply means on the basis of a toner amount per unit volume that is detected.

Effect of the Invention

According to the present invention, the reference supply amount is corrected on the basis of the amount of the toner per unit volume just before the toner is supplied to the developing means, so that it is possible to appropriately supply the toner in consideration of variations in the aspect of the toner, and the concentration of the toner within the developing means can be correctly controlled so as to be a desired value.

BRIEF DESCRIPTION OF THE DRAWINGS

FIG. 7 is a data table showing a relation among reference supply amounts to be decided by estimated amounts of toners and average concentration of a toner within a developing device.

FIG. 8 is a data table showing a relation among correction amounts of a developer to be decided by reference supply amount that are decided by the data table of FIG. 8 and concentrations of a toner to be detected within a sub hopper.

BEST MODE FOR CARRYING OUT THE INVENTION

Hereinafter, the embodiment(s) according to the present invention will be described with reference to the drawings. However, in the following explanation, unless specifically described, the technical scope of the present invention is not limited only to kinds, combinations, shapes, and relative arrangements or the like of the constituent elements. In addition, as necessary, the terms showing specific directions and positions (for example, "above", "below", "one end", and "other end" or the like) are used; however, these terms are used in order to make the understanding of the invention with reference to the drawings easy and due to meanings of these terms, the technical scope of the present invention is not limited.

(Constitution)

Figure 1:
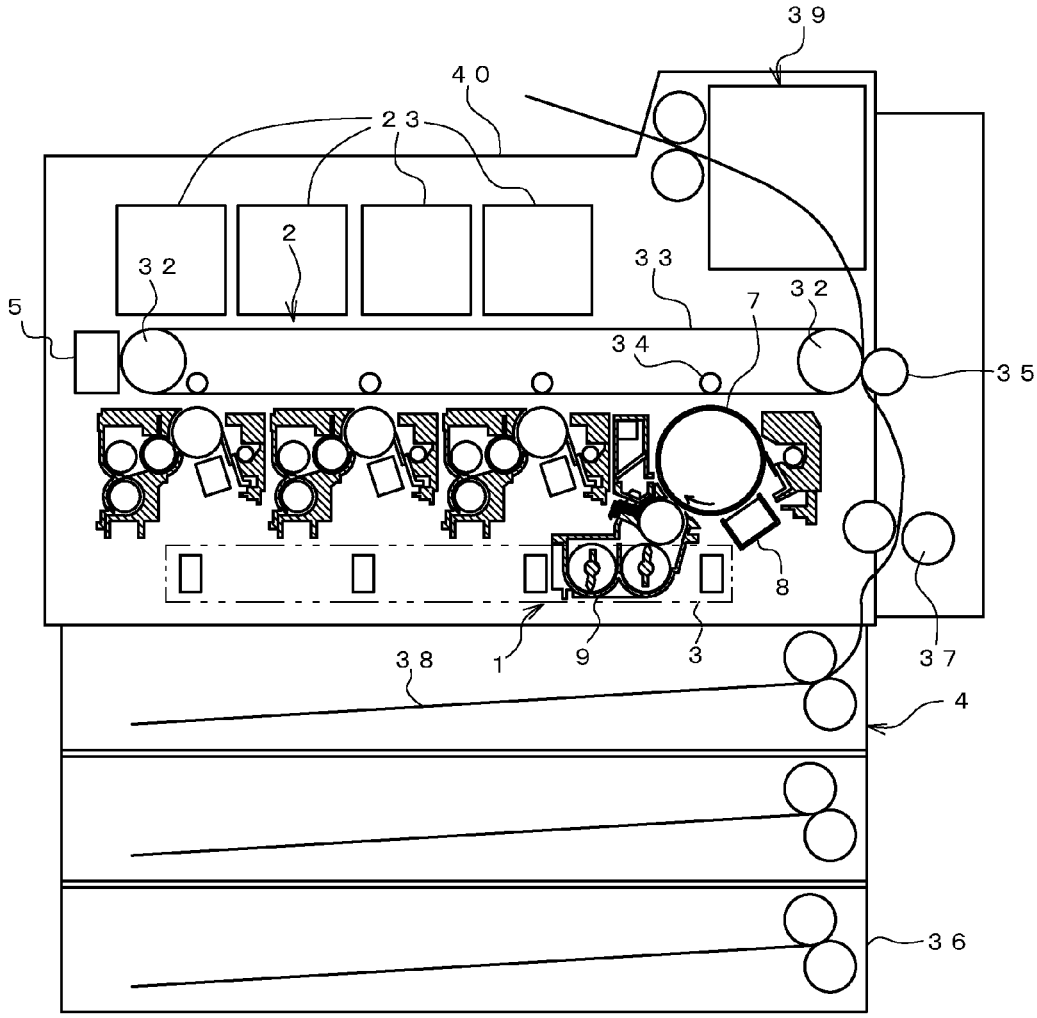
FIG. 1 is a schematic front view of an image forming device according to the present embodiment.
Figure 5:
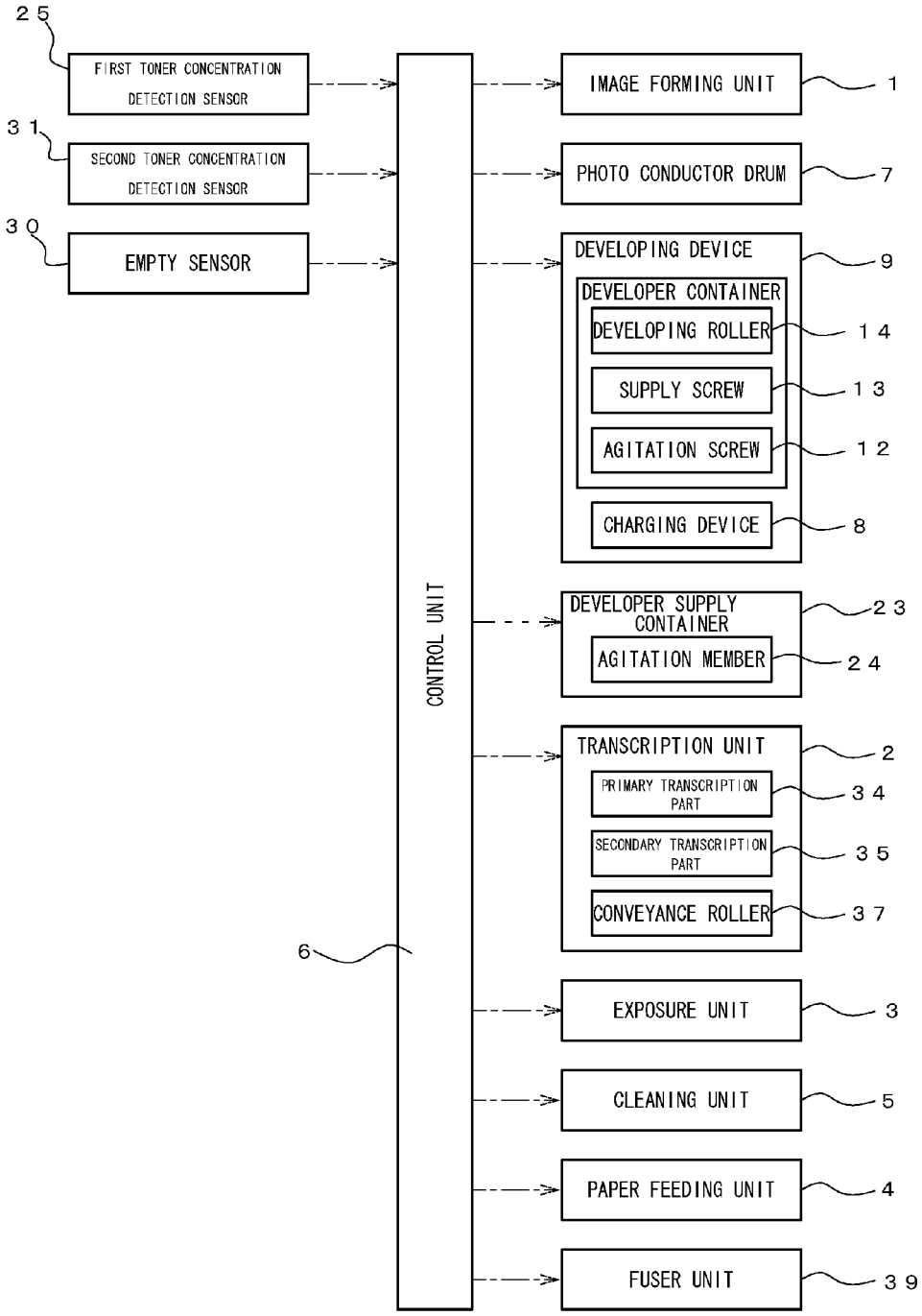
FIG. 5 is a block diagram of the image forming device according to the present embodiment.

Among image forming devices of an electro photographic system using a binary developer, FIG. 1 particularly illustrates an image forming device of a so-called trickle system that supplies not only toner but also a small amount of carrier. This image forming device is largely provided with image forming units 1, a transcription unit 2, an exposure unit 3, a paper feeding unit 4, a cleaning unit 5, and a control unit 6 (refer to FIG. 5) or the like.

Figure 2:
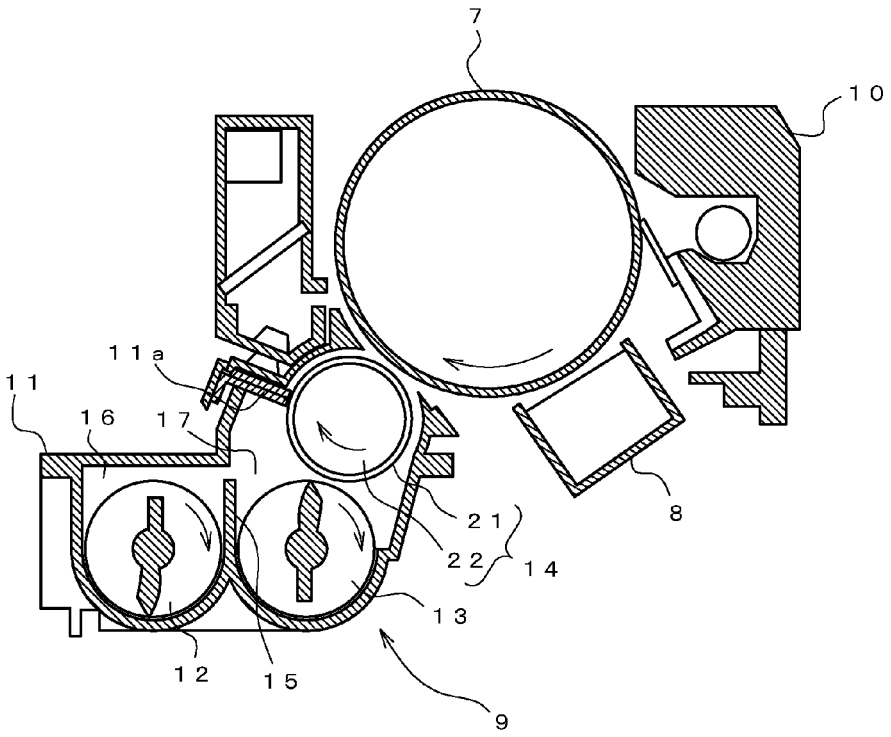
FIG. 2 is a schematic front sectional view showing each image forming unit of FIG. 1.

The image forming units 1 are arranged on four places along an intermediate transcription belt 33 of the transcription unit 2, and by forming images of yellow (Y), magenta (M), cyan (C), and black (Bk), from the left side, respectively, the image forming units 1 form color images on the surface of the intermediate transcription belt 33. As shown in FIG. 2, respective image forming units 1 are provided with a charging device 8, a developing device 9, and a cleaning device 10 or the like around a photo conductor drum 7.

The charging device 8 forms a predetermined surface potential on the surface of the photo conductor drum 7. This surface potential is made into an electrostatic latent image when the surface of the photo conductor drum 7 is exposed by the exposure unit 3.

Figure 3:
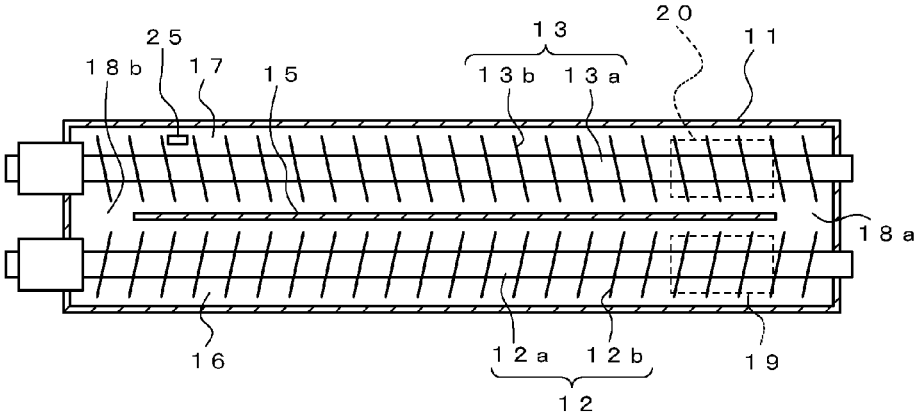
FIG. 3 is a schematic plan sectional view of a developer container of FIG. 2.

As shown in FIG. 2 and FIG. 3, the developing device 9 has an agitation screw 12, a supply screw 13, and a developing roller 14, which are respectively contained in a developer container 11.

Figure 6:
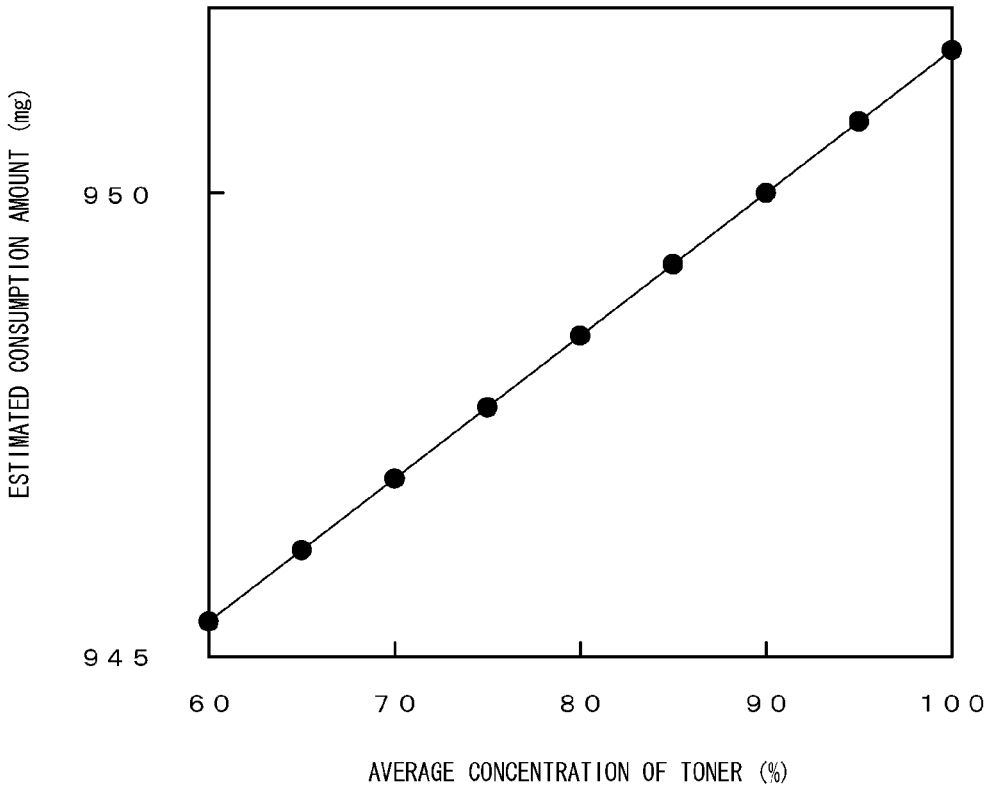
FIG. 6 is a graph showing a relation between sensor outputs of a concentration of a toner detection sensor and concentrations of a toner.

As shown in FIG. 3, the developer container 11 is formed as a long box that is elongated from one end to other end, and the developer container 11 is divided into two parts by a partition wall 15, namely, a first containing part 16 and a second containing part 17 along a longitudinal direction. However, the opposite end sides of the first containing part 16 and the second containing part 17 are communicated with each other by communication parts 18*a* and 18*b*, and the contained developer is cyclically moved, being agitated. In addition, the developer container 11 is provided with a first toner concentration detection sensor 25 as means of detecting the amount of the toner per unit volume. The first toner concentration detection sensor 25 is a conventionally well-known one that outputs a difference in a magnetic permeability of the developer as a frequency and calculates a concentration of a toner (a weight ratio of the toner for the developer) in accordance with the graph of FIG. 6.

A developer supply port 19 is formed on one end side of the first containing part 16, and as described later, the developer is supplied from a corresponding developer supply container 23. Here, as the developer, a binary developer containing a toner and a carrier is used. However, the developer may further contain an external addition agent or the like.

On the other hand, a developer discharge port 20 is formed on one end side of the second containing part 17 so as to prevent a carrier that is deteriorated from remaining in the developer container 11 over a long period by appropriately discharging the developer.

The agitation screw 12 is structured being provided with a spiral wing 12*b* around a rotation shaft 12*a* to be arranged in the first containing part 16. The agitation screw 12 is rotary-driven to agitate the developer, conveying the developer from one end side to other end side.

The supply screw 13 is arranged in the second containing part 17 having a spiral wing 13*b* placed around a rotation shaft 13*a* as well as the above-described agitation screw 12. The supply screw 13 is rotary-driven to transport the developer from the side of the communication parts 18*b* to the side of the communication part 18*a* and supplies the developer to the developing roller 14.

As shown in FIG. 2, the developing roller 14 has a plurality of permanent magnets 22 in the cylindrical sleeve 21 (here, five permanent magnets S2, N2, S1, N1, and S3 are arranged in this order in a clockwise direction). The sleeve 21 is structured so as to be rotated in an arrow direction in the drawing by sleeve driving means (not illustrated).

Figure 4:
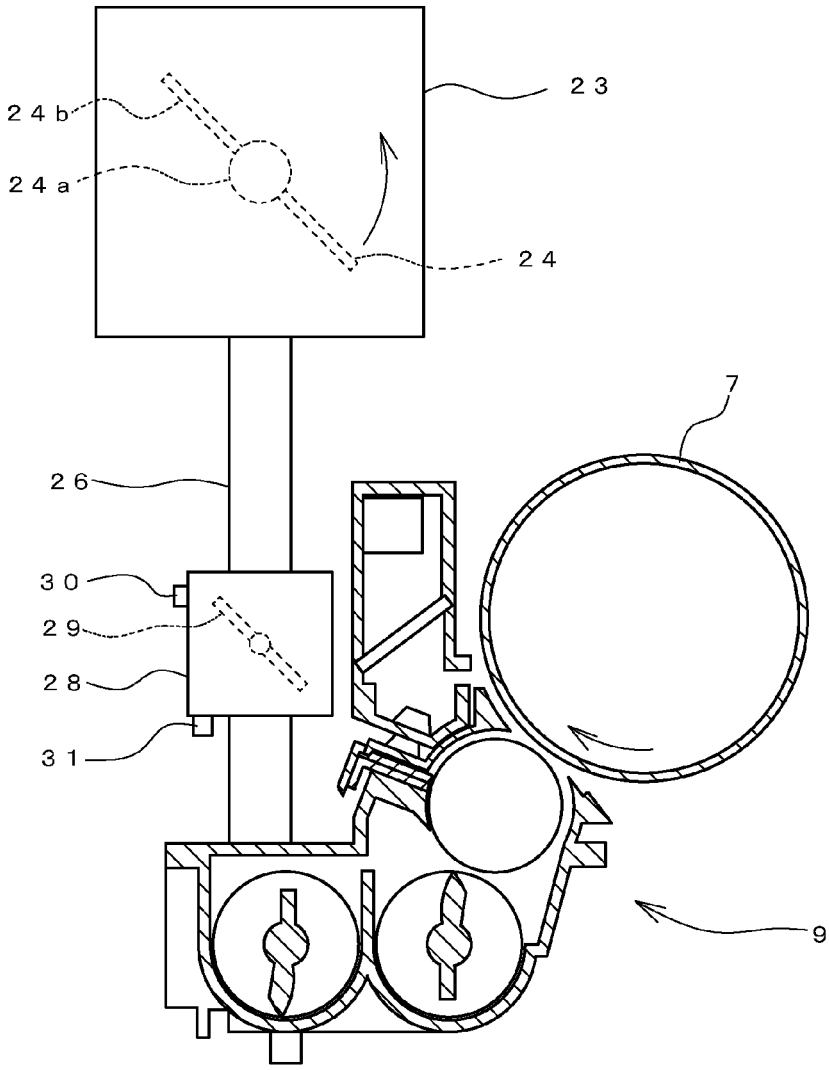
FIG. 4 is a schematic front view showing an image forming unit and a developer supply container of FIG. 1.

As shown in FIG. 4, the developer supply container 23 for supplying a binary developer for supply composed of toner and a carrier (hereinafter, merely described as a developer) is detachably located above the developing device 9. The developer contained in the developer supply container 23 is appropriately agitated by an agitation member 24. The agitation member 24 is formed by integrally arranging paddles 24*b* of tabular shapes with predetermined intervals on plural places around a rotation shaft 24*a*.

The lower surface of the developer supply container 23 and the upper surface of the developer container 11 are connected by a supply tube 26 that forms a supply path. Further, a concentration of a toner of the developer to be contained in the developer container 11 in advance is 7%; and a concentration of a toner of the developer to be supplied from the developer supply container 23 is 80% (a carrier concentration is 20%, generally, 10 to 20%).

In the middle of the supply tube 26, a sub hopper 28 is connected. Paddles 29 (they may be a rotation coil or the like) are contained in the sub hopper 28, and when the paddles 29 are appropriately rotated, the developer is supplied. On the upper side surface of the sub hopper 28, an empty sensor 30 is placed. As the empty sensor 30, a photo sensor, a piezoelectric sensor, and a magnet lead sensor or the like can be used. The empty sensor 30 detects that the amount of the developer in the sub hopper 28 is not more than a predetermined value.

In addition, at a lower surface corner portion of the sub hopper 28, as means of detecting the amount of the toner per unit volume, a second toner concentration detection sensor 31 is provided. As the second toner concentration detection sensor 31, one having a sufficient sensitivity even in a high concentration region with a concentration of a toner (a weight ratio) not less than 50% is available. For example, a magnetic type of a sensor may be used, which is configured to detect a concentration of a toner component in the developer by change in a frequency of a resonance circuit formed by an inductance and a capacitance (in detail, refer to Japanese Patent Application Laid-Open No. 11-119538). Further, a method of calculating a concentration of a toner from a detection signal detected by the second toner concentration detection sensor 31 is identical with that of the above-described first toner concentration detection sensor 25.

After transcription of the toner to the surface of the photo conductor drum 7, collecting the toner remaining on this surface, the cleaning device 10 cleans this surface.

As shown in FIG. 1, the transcription unit 2 is structured in such a manner that the intermediate transcription belt 33 is rounded between a pair of support rollers 32, and driving the support rollers 32 by means of driving means (not illustrated), the intermediate transcription belt 33 is cyclically moved in an arrow direction. The transcription unit 2 is provided with a primary transcription part 34 and a secondary transcription part 35.

The exposure unit 3 irradiates a laser beam to the above-described photo conductor drum 7 to form an electrostatic latent image corresponding to the image data that is read by a scanner (not illustrated).

The paper feeding unit 4 conveys recording medium 38 contained in a cassette 36 to the secondary transcription part 35 in series via a conveyance roller 37. A toner image is transcribed to the recording medium 38 that is conveyed to the secondary transcription part 35, and after the toner image transcribed by a fuser unit 39 is fixed, the recording medium 38 is conveyed to a discharge tray 40.

The cleaning unit 5 is capable of coming contact with and being detached from the intermediate transcription belt 33 and the cleaning unit 5 collects the remaining toner on the surface of the intermediate transcription belt 33 when the cleaning unit 5 gets close to the intermediate transcription belt 33 and cleans the intermediate transcription belt 33.

The control unit 6 carries out the supply processing of the developer on the basis of the detection voltages to be inputted from respective toner concentration detection sensors 25 and 31 as described later.

(Operation)

Next, the operation of the image forming device that is formed by the above-described constitution will be described.

At the time of forming images, the color print data that is obtained by reading the image, or the image data that is outputted from a personal computer or the like is transmitted to each of the image forming units 1 as an image signal of each color, yellow (Y), magenta (M), cyan (C), and black (Bk) after being applied with predetermined signal processing.

Respective image forming units 1 form latent images by projecting the laser beam that is modulated by image signals on the photo conductor drum 7. Then, respective image forming units 1 supply the toner from the developing device 9 to the photo conductor drum 7.

By rotary-driving the agitation screw 12 and the supply screw 13, the developing device 9 circulates the developer contained in the developer container 11 while agitating the developer. Then, supplying the toner from the supply screw 13 to the developing roller 14, the toner is scraped out by a regulation member 11*a* to be a constant amount. After that, the developing device 9 conveys the toner to the photo conductor drum 7.

Thereby, on respective photo conductor drums 7, toner images of yellow, magenta, cyan, and black are formed. The formed yellow, magenta, cyan, and black toner images are primarily transcribed by the primary transcription part 34 being superimposed on the moving intermediate transcription belt 33 in series. Thus, the superimposed toner images that are formed on the intermediate transcription belt 33 are moved to the secondary transcription part 35 in accordance with movement of the intermediate transcription belt 33.

In addition, the recording medium 38 is supplied from the paper feeding unit 4. The supplied recording medium 38 is conveyed between the secondary transcription part 35 and the intermediate transcription belt 33 by the conveyance roller 37, and then, the toner images formed on the intermediate transcription belt 33 are transcribed on this recording medium 38. The recording medium 38 having the toner images transcribed is further conveyed to a fuser device 39, and after the transcribed toner images are fixed there, the recording medium 38 is discharged to the discharge tray 40.

In the mean time, in the developing device 9, the concentration of the toner of the contained developer is lowered by supplying the toner to the photo conductor drum 7, and the carrier is deteriorated by usage over a long period. Therefore, by appropriately discharging and supplying the developer, the amount of the developer in the developer container 11 is maintained approximately constant.

For example, the supply processing of the developer will be carried out as follows.

(First Supply Processing of Developer)

Figure 9:
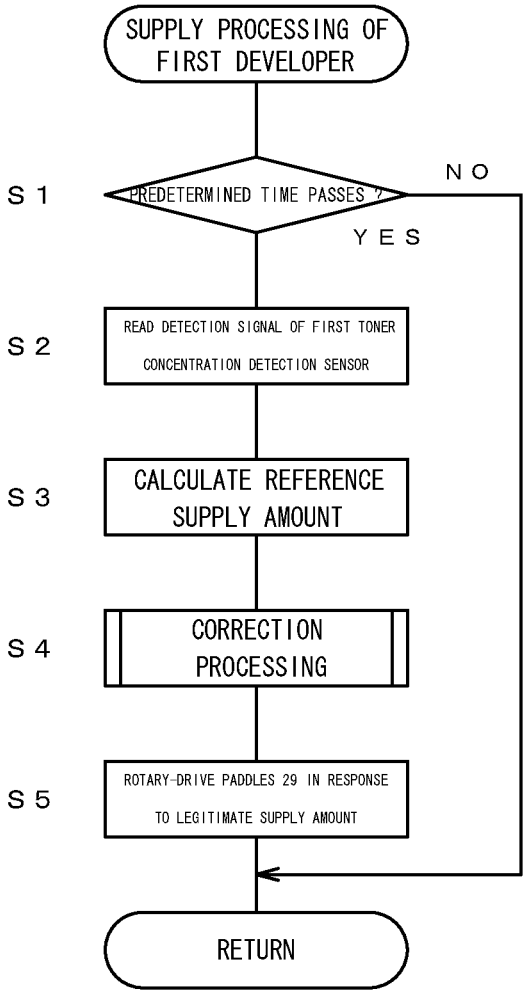
FIG. 9 is a flow chart showing the content of the supply processing of a first developer according to the present embodiment.

In other words, in the flow chart of FIG. 9, when predetermined time has been passed (step S1), a detection signal to be outputted from the first toner concentration detection sensor 25 is read (step S2). Here, by driving the agitation screw 12 and the supply screw 13 and moving the developer for a predetermined tine, the concentration of the toner after the concentration of the toner is made to be approximately unified is read. The developer may be moved for full circle, or quarter circle. The bottom line is that the developer is moved so as to obtain nearly unified concentration of the toner across the developing device 9.

Then, on the basis of the read detection signal, the reference supply amount is calculated (step S3). Then, on the basis of a relation between the preliminarily-obtained reference supply amount and the rotation-driving time of the paddles 29 in the sub hopper 28, the rotation-driving time of the paddles 29 is set. The more the detected concentration of the toner is decreased, the longer the rotation time of the paddles 29 is set.

Figure 10:
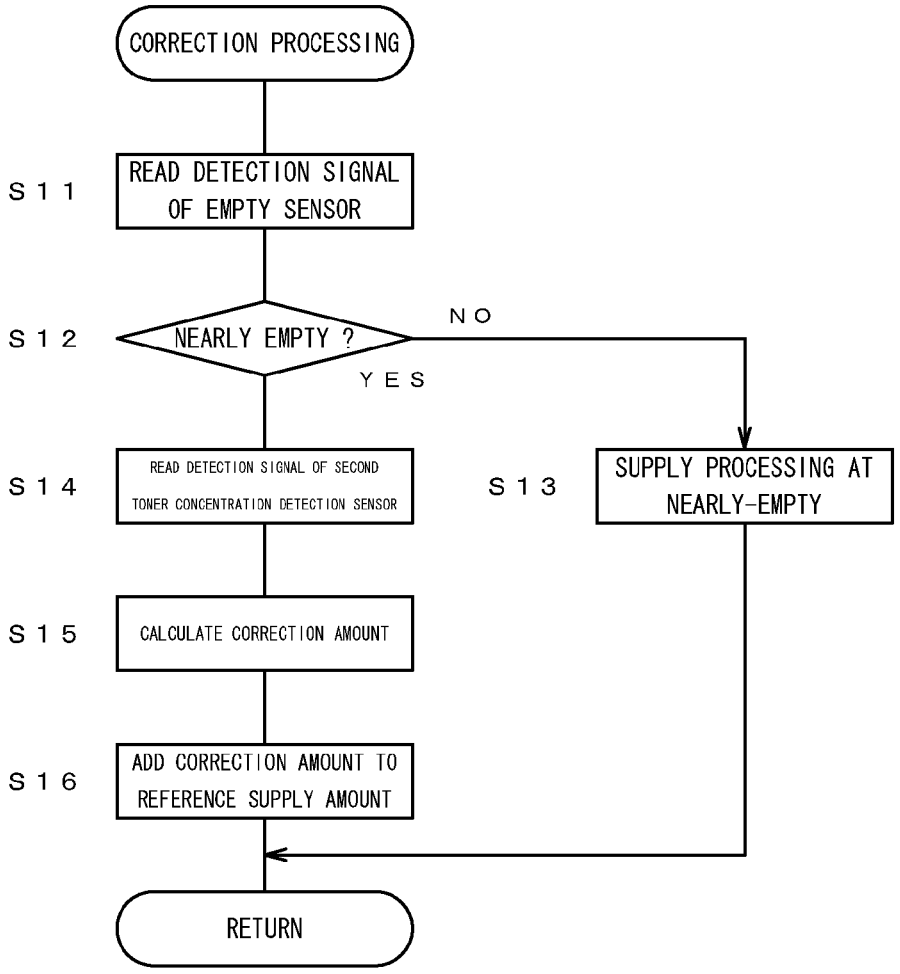
FIG. 10 is a flow chart showing the content of the correction processing of FIG. 9.

When the reference supply amount of the developer is calculated in this way, the correction processing for correcting the supply amount of the developer is carried out. According to the correction processing, as shown in the flowchart of FIG. 10, at first, a detection signal in the empty sensor 30 is read (step S11). Then, on the basis of the read detection signal, it is judged whether or not the developer in the sub hopper 28 is nearly empty (step S12). Here, "nearly empty" means the state such that the first driving member 23 is vacant, the developer is not supplied to the inside of the sub hopper 28, and the amount of the developer in the side hopper 28 is not more than the reference value.

If the developer is judged to be nearly empty, the supply processing in response to the state is carried out (step S13). In other words, without correcting the supply amount of the developer as described later, as shown in the above-described steps S1 to S3, the reference supply amount of the developer is calculated and this reference supply amount is defined as a legitimate supply amount. This is because, if the developer is the state of nearly-empty, the amount of the developer in the sub hopper 28 is decreased, and this makes it impossible to correctly detect the concentration of the toner.

If the developer is not judged to be nearly-empty, a detection signal detected by the second toner concentration detection sensor 31 (means of detecting toner amount before supply) is read (step S14). Then, on the basis of the read detection signal, namely, the concentration of the toner, with reference to the supply amount correction table shown in FIG. 8, the correction amount with respect to the reference supply amount of the developer is calculated (step S15). In other words, on the basis of the concentration of the toner in the sub hopper 28 that is detected by the second toner concentration detection sensor 31, the correction amount with respect to the reference supply amount that is obtained as described above is obtained. Here, the correction amount with respect to each reference supply amount is to be decided in six stages, namely, up to 50%; 50 to 60%; 60 to 70%; 70 to 80%; 80 to 90%; and 90 to 100%. In detail, if the concentration of the toner to be detected is in the range of 80 to 90%, the correction amount is made into 0 because this is within the range of the desired concentration (the reference concentration). In addition, if the concentration of the toner to be detected is less than 80%, the toner amount to be supplied is smaller than the desired amount. Therefore, in response to a decrease level of the concentration of the toner, the supply amount of the developer is corrected so as to be increased. On the contrary, if the concentration of the toner to be detected is not less than 90%, the amount of the toner to be supplied is increased than the desired amount, so that the supply amount of the developer is corrected so as to be limited. If the supply amount is calculated, adding the correction amount to the reference supply amount, a legitimate supply amount is calculated (step S16). Further, the segment of the concentration of the toner to be detected is not limited to the above-described six stages, but the segment may be further broken (according to the circumstances, no stage) or the concentration of the toner to be detected may be divided into the stages less than six.

If the supply control processing is completed, by rotating the paddles 29 for a time on the basis of the calculated supply amount of the developer, the developer is supplied.

Thus, according to the above-described supply processing of the developer, detecting the concentration of the toner of the developer just before being supplied to the developer container 11, on the basis of this detection result, not only the reference supply amount from the corresponding developer supply container 23 is decided, but also this reference supply amount is corrected. Thereby, it is possible to stabilize the amount of the toner to be supplied to the inside of the developer container 11, so that it is possible to correctly control the concentration of the toner in the developer container 11 to be a desired value.

(Second Supply Processing of Developer)

Figure 15:
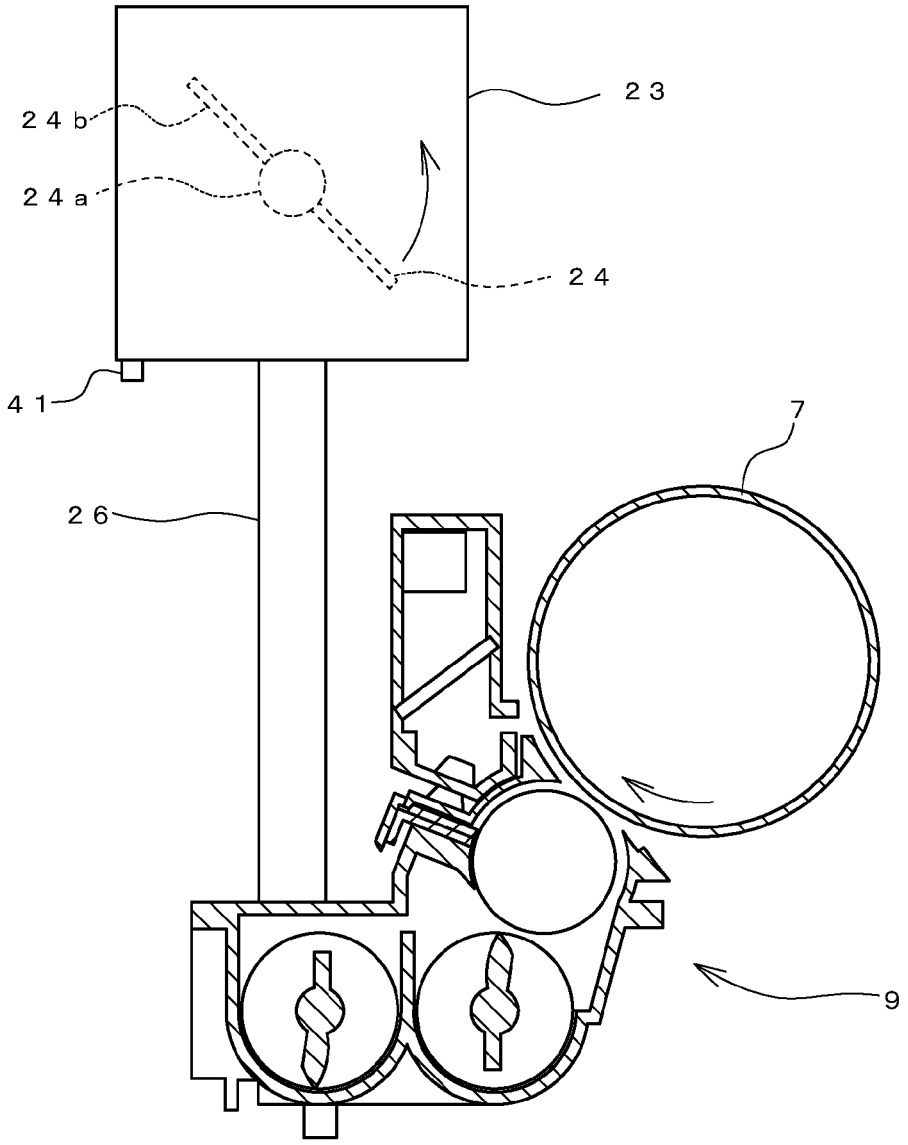
FIG. 15 is a schematic front view showing a developer container and a developing device according to other embodiment.

According to the second supply processing of developer, the developing device 9 and the developer container 23 are configured as shown in FIG. 15. In other words, eliminating the sub hopper 28 from the configuration shown in FIG. 4, as means of detecting the amount of the toner per unit volume, a third toner concentration detection sensor 41 is placed on the lower surface of the developer container 11 and in the vicinity of the supply tube 26. Further, since other configurations are the same as the configurations shown in FIG. 4, the identical reference numerals are given to the corresponding parts and the explanation thereof is herein omitted.

Figure 11:
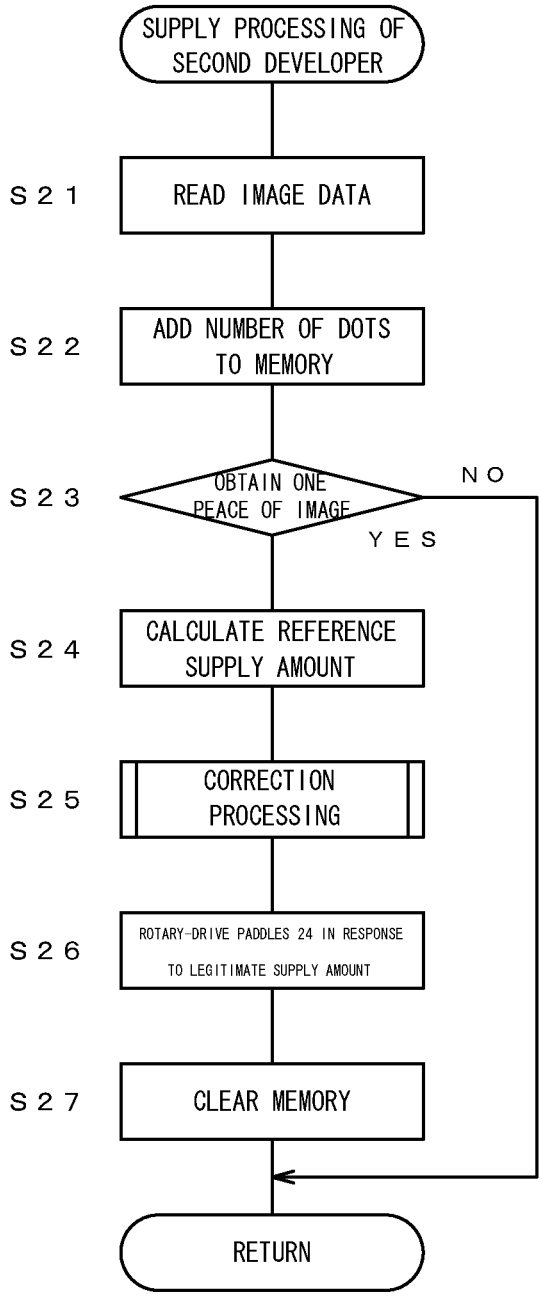
FIG. 11 is a flow chart showing the content of the supply processing of a second developer according to the present embodiment.

Then, the second supply processing of developer will be carried out as follows. In other words, as shown in the flow chart of FIG. 11, obtaining the image data (step S21), the number of dots to be obtained from the obtained image data is added to a memory of the control unit 6 (step S22). Then, if the image data corresponding to one piece of the recording medium 38 is completely obtained (step S23), on the basis of a total of the number of dots accumulated in the memory, the reference supply amount of the developer is calculated (step S24). In other words, the consumption amount of the toner is obtained by multiplying the total of the number of dots since the consumption amount of the toner per dot is known in advance, so that the total of the developer that can supply the toner of the amount corresponding to this consumption amount of the toner is defined a reference supply amount.

When the reference supply amount of the developer is calculated in this way, the correction processing will be carried out (step S25).

Figure 12:
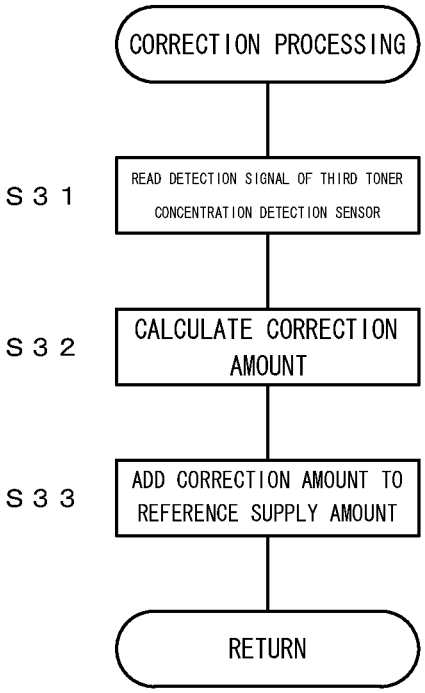
FIG. 12 is a flow chart showing the content of the correction processing of FIG. 11.

As shown in the flow chart of FIG. 12, in the correction processing, reading detection signals to be outputted from the third toner concentration detection sensor 41 (the means of detecting toner amount before supply) (step S31), with reference to a supply amount correction table shown in FIG. 8, the correction amount with respect to the reference supply amount of the developer will be calculated (step S32). Then, adding the calculated correction amount to the reference supply amount, a legitimate supply amount is obtained (step S33).

If the supply control processing is completed, by rotating the paddles 24 for a time on the basis of the calculated supply amount of the developer, the developer is supplied. In addition, the number of dots stored in the memory of the control unit 6 is cleared (=0) (step S26).

(Third Supply Processing of Developer)

Figure 16:
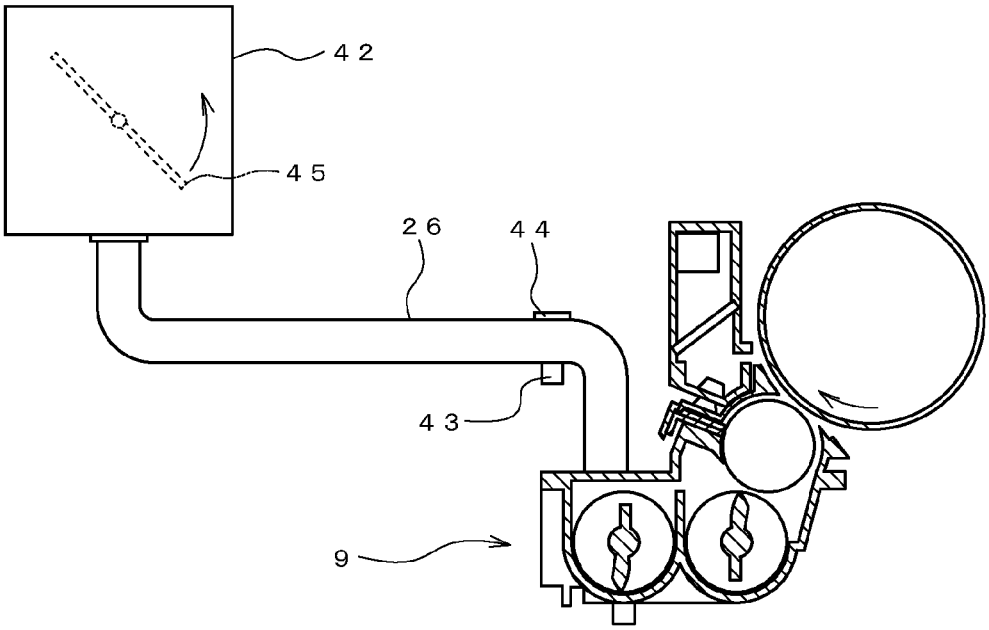
FIG. 16 is a schematic front view showing the developer container and the developing device according to other embodiment.

According to the third supply processing of developer, the developing device 9 and the developer container 23 are configured as shown in FIG. 16. In other words, the developing device 9 is a binary developing device using a binary developer composed of normal toner and carrier, and this configuration of the developing device 9 is identical to the configuration of the developing device 9 shown in FIG. 4 except for the point that no developer discharge port 20 is provided. Further, from a toner supply container 42, a toner is only supplied to the developing device 9 and no carrier is supplied thereto.

In addition, in the middle of the supply tube 26 that supplies the toner from the toner supply container 42 to the developing device 9, a magnetic permeability sensor 43 and a magnetic body 44 are arranged being opposed so as to hold the supply tube 26 from the opposite sides. Then, by using change in the output of the magnetic permeability sensor 43 in response to the amount of the toner passing between the magnetic permeability sensor 43 and the magnetic body 44, a bulk density of the toner is detected.

Further, paddles 45 are arranged in the toner supply container 42 so as to be capable of being rotary-driven. These paddles 45 are normally stopped, and in the case that a supply signal is outputted on the basis of the output from the first toner concentration detection sensor 25, which is arranged in the developer container 11 of the developing device 9, the paddles 45 are rotary-driven for a predetermined time. Thereby, the toner of the amount in response to the rotation time is supplied to the inside of the developing device 9 via the supply tube 26.

Further, since other configurations are the same as the configurations shown in FIG. 4, the identical reference numerals are given to the corresponding parts and the explanation thereof is herein omitted.

Figure 13:
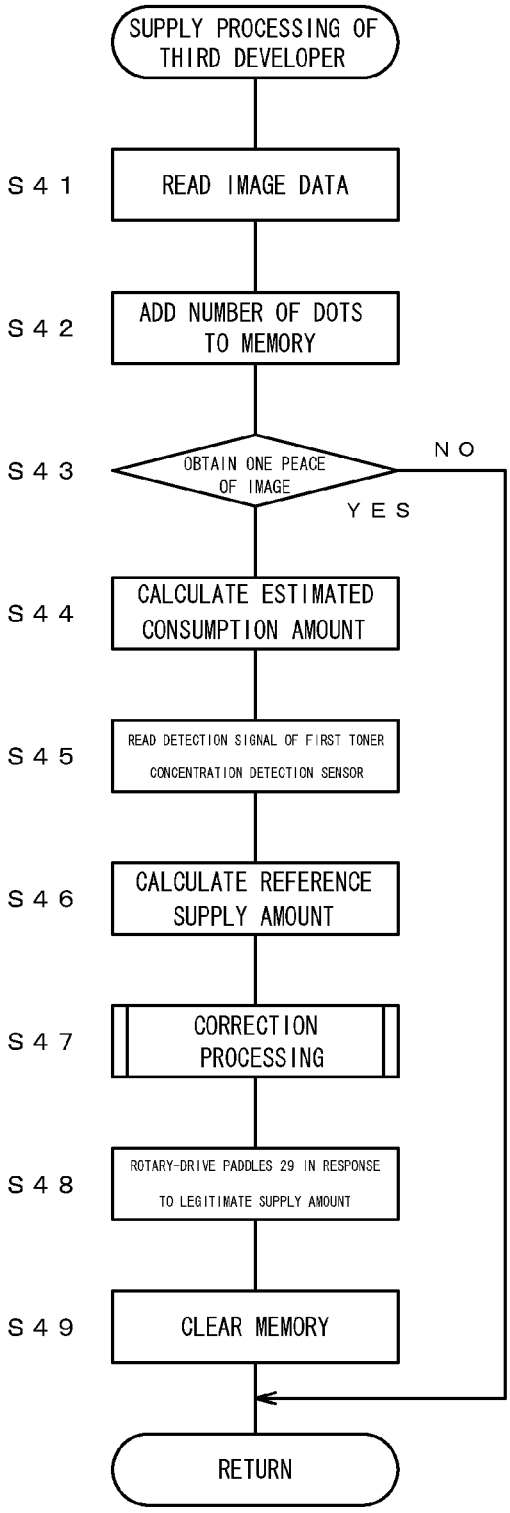
FIG. 13 is a flow chart showing the content of the supply processing of a third developer according to the present embodiment.

The third supply processing of developer incorporates the contents of the above-described two supply processing of developer as shown in the flow chart of FIG. 13. In other words, obtaining the image data (step S41), the number of dots to be obtained from the obtained image data is added to the memory of the control unit 6 (step S42). Then, if the image data corresponding to one piece of the recording medium 38 is completely obtained (step S43), on the basis of a total of the number of dots accumulated in the memory, the estimated consumption amount of the developer is calculated (step S44). In addition, detection signals to be outputted from the first toner concentration detection sensor 25 are read (step S45). Here, on the basis of the estimated consumption amount of the developer and the detection signals outputted from the first toner concentration detection sensor 25, in accordance with the data table shown in FIG. 7, the reference supply amount is calculated (step S46), the correction processing is carried out (step S47).

Figure 14:
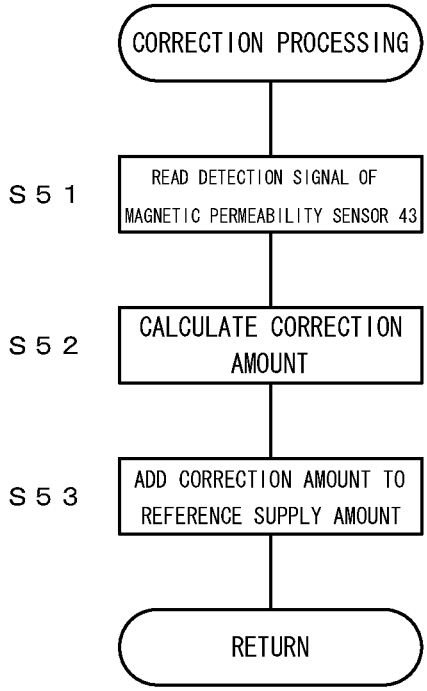
FIG. 14 is a flow chart showing the content of the correction processing of FIG. 13.

According to the correction processing, as shown in FIG. 14, on the basis of the detection signals to be outputted from the magnetic permeability sensor 43, the bulk density of the toner passing, the amount of the toner per unit volume, namely, the concentration of the toner is calculated from this bulk density. Then, the concentration of the toner is read (step S51), and with reference to the supply amount correction table (not illustrated), the correction amount with respect to the reference supply amount of the developer is calculated (step S52). Subsequently, adding the calculated correction amount to the reference supply amount, a legitimate supply amount is obtained (step S53).

If the supply control processing is completed, by rotating the paddles 45 for a time in response to the calculated supply amount of the developer, the developer is supplied. In addition, the number of dots stored in the memory of the control unit 6 is cleared (=0) (step S47).

Further, the present invention is not limited to the configurations described in the above-described embodiment, and various modifications can be made.

The above-described sub hopper 28 is not necessarily needed. In this case, the magnetic permeability sensor may be placed in the middle of the supply tube 26. In addition, as necessary, it is preferable that the concentration of the toner is unified by arranging a coil for agitation or the like in the supply tube 26.

According to the above-described first supply processing of developer, in the configuration that the reference supply amount is decided on the basis of the concentration of the toner of the developer in the developer container 11 that is detected by the first toner concentration detection sensor 25, the correction amount is calculated on the basis of the concentration of the toner of the developer to be supplied to the inside of the developer container 11 that is detected by the second toner concentration detection sensor 31 provided in the sub hopper 28; however, the present invention is not limited to this. Without providing the sub hopper 28, providing a toner concentration detection sensor in the vicinity of the supply port of the corresponding developer supply container 23, the correction amount with respect to the reference supply amount may be calculated on the basis of the concentration of the toner to be detected by this detection sensor.

In addition, according to the above-described first supply processing of developer, the reference supply amount is decided on the basis of only the concentration of the toner of the developer in the developer container 11; however, also considering the estimated consumption amount of the developer to be obtained by counting the number of dots of the image data, the reference supply amount may be decided.

The invention claimed is:

1. An image forming device, comprising:

powder supply means adapted to supply powders containing at least toner;

developing means adapted to develop an electrostatic latent image by agitating and conveying a developer containing the powders that are supplied by said powder supply means;

means of detecting toner amount per unit volume that is placed in the middle of a conveyance path connecting said powder supply means with said developing means and detects a toner amount per unit volume of the powders in the conveyance path before the powders are supplied to said developing means; and control means that determines a correction amount based on: (i) a reference supply amount of powders to be supplied to the developing means, and (ii) the toner amount per unit volume that is detected by said detecting means.

2. The image forming device according to claim 1, wherein:

a hopper that accumulates the powders to be supplied is placed in the middle of the conveyance path;

agitation means adapted to agitate the accumulated powders is placed in said hopper; and said toner amount detecting means is placed in said hopper.

3. The image forming device according to claim 1, wherein:

said toner amount detecting means comprises a magnetic permeability sensor and a magnetic body that are arranged along the conveyance path; and said control means calculates a toner amount to be supplied on the basis of a bulk density of the toner passing through said conveyance path, which bulk density is detected by said permeability sensor and said magnetic body, so as to control the correction amount with respect to the reference supply amount.

4. The image forming device according to claim 3, wherein:

the powders to be supplied from said powder supply means to said developing means are toner.

5. The image forming device according to claim 1 wherein:

the powders to be supplied from said powder supply means to said developing means include toner and a carrier.

6. The image forming device according to claim 1, wherein the control means determines an actual supply amount by adding the correction amount to the reference supply amount.

7. The image forming device according to claim 6 wherein:

the powder supply means houses a rotation member configured to discharge powders from the powder supply means into the conveyance path; and the control means determines an amount of time for rotating the rotation member based on the actual supply amount.

8. The image forming device according to claim 1, further comprising:

a second detecting means that detects a toner amount per unit volume of powders inside the developing means; and wherein the control means determines the reference supply amount based on the toner amount per unit volume detected by the second detecting means.

9. A developer supply method, wherein:

detecting a toner amount per unit volume in powders to be supplied to developing means in the middle of a conveyance path connecting powder supply means, adapted to supply powders containing at least toner, with the developing means adapted to develop an electrostatic latent image by agitating and conveying the powders that are supplied by said powder supply means;

determining a correction amount based on: (i) a reference supply amount of powders to be supplied to the developing means, and (ii) the toner amount per unit volume that is detected.

10. The developer supply method according to claim 9 further comprising determining an actual supply amount by adding the correction amount to the reference supply amount.

11. The developer supply method according to claim 10, further comprising determining an amount of time for rotating a rotation member that discharges powders from the powder supply means into the conveyance path based on the actual supply amount.

12. The developer supply method according to claim 9 further comprising:

detecting a toner amount per unit volume of powders inside the developing means; and determining the reference supply amount based on the toner amount per unit volume of the powders inside the developing means.

* * * * *